US009546543B2

(12) United States Patent
Mansperger

(10) Patent No.: US 9,546,543 B2
(45) Date of Patent: Jan. 17, 2017

(54) REMOTE CONTROLLED DRILLING RIG

(71) Applicant: Coby W. Mansperger, Dalhart, TX (US)

(72) Inventor: Coby W. Mansperger, Dalhart, TX (US)

( * ) Notice: Subject to any disclaimer, the term of this patent is extended or adjusted under 35 U.S.C. 154(b) by 368 days.

(21) Appl. No.: 14/184,670

(22) Filed: Feb. 19, 2014

(65) Prior Publication Data

US 2014/0231138 A1 Aug. 21, 2014

Related U.S. Application Data

(60) Provisional application No. 61/766,246, filed on Feb. 19, 2013.

(51) Int. Cl.
*E21B 15/00* (2006.01)
*E21B 44/00* (2006.01)
*E21B 7/02* (2006.01)

(52) U.S. Cl.
CPC ..... *E21B 44/00* (2013.01); *E21B 7/02* (2013.01); *E21B 15/00* (2013.01)

(58) Field of Classification Search
CPC ..... E21B 44/00; E21B 15/00; E21B 7/02; E21B 7/023; E21B 7/026
See application file for complete search history.

(56) References Cited

U.S. PATENT DOCUMENTS 4,899,832 A * 2/1990 Bierscheid, Jr. ..... E21B 19/14 173/184
2009/0084558 A1* 4/2009 Bloom ..... E21B 7/02 166/385
2011/0224859 A1* 9/2011 Pipponen ..... E21B 7/025 701/22

* cited by examiner

*Primary Examiner* — Brad Harcourt

(57) ABSTRACT

A remote controlled drilling rig that is fully functional includes a drilling rig, an electrical assembly, and a remote. The drilling rig includes a truck for towing a semi-trailer on which is positioned a derrick and a drilling assembly. The electrical assembly is positioned within the drilling rig and includes a battery for powering components of the drilling rig, in addition to a receiver and circuit board for receiving and processing command signals respectively. The receiver is communicably coupled to a transmitter housed within a casing of the remote. A plurality of controls is used to send input commands to the transmitter, which are in turn transmitted to the receiver in order to control functions of the drilling rig, such as raising and lowering the derrick. A draw-works assembly allows for raising and lowering a traveling block within the derrick by winding and unwinding a drilling cable connected between.

18 Claims, 15 Drawing Sheets

REMOTE CONTROLLED DRILLING RIG

The current application claims a priority to the U.S. Provisional Patent application Ser. No. 61/766,246 filed on Feb. 19, 2013.

FIELD OF THE INVENTION

The present invention relates generally to remote controlled devices. More specifically, the present invention is a fully functional remote controlled on shore mobile drilling rig for scaled model trucks.

BACKGROUND OF THE INVENTION

Drilling into the Earth's surface is a major aspect of acquiring and extracting resources such as natural gas and oil. An integral piece of machinery in the process of resource acquisition and extraction is the drilling rig. Drilling rigs are commonly large, permanent structures that are constructed on-site at drilling locations. These large pieces of machinery house the components that perform a variety of functions such as penetrating the Earth's crust to gain access to deep underground resources. A drill bit is connected to a rotary table and lowered into the ground to form a well bore. The drill bit and assembly are supported by a hoist. As drilling is often conducted deep under the Earth's surface, additional piping must be incorporated onto the drill in order to maintain the attachment between the drill bit and the rotary table. Additionally, drilling into the ground produces a large amount of debris that accumulates in the well bore. In order to remove the debris and keep the drill bit clean, drilling fluid or "mud" is pumped into the well bore through the piping. The drilling mud performs other functions such as sealing any fractures within the well bore as well as keeping the drill bit cool. Because of the resources and manpower required to construct permanent drilling rigs on-site at drilling locations, mobile drilling rigs are often mounted on trucks and trailers. These mobile drilling rigs generally encompass mounted derricks that are lowered during transport and raised after arrival at the drill site.

The present invention is a fully functional remote controlled on shore mobile drilling rig. The present invention comprises a remote controlled truck, a semi-trailer, and a derrick. The scaled model derrick is mounted to the semi-trailer. As with its full sized counterpart, the model derrick may be lowered and raised as necessary. In its preferred embodiment, the present invention is capable of performing the same functions as those of a full sized conventional drilling rig. The present invention is capable of hoisting and supporting a drill bit assembly as well as piping for drilled well bores. The drill bit is rotated by means of a rotary table and is capable of creating well bores in the ground. The hoisting assembly comprises drill line that is threaded through a pulley system and operated by motorized draw-works. The draw-works raises and lowers a traveling block. The traveling block, in conjunction with the pulley system and drill line, is capable of lifting and supporting large amounts of weight. Various embodiments of the present invention may incorporate the ability to pump drilling mud into bore wells. In these embodiments of the present invention, additional drilling mud equipment such as a mud tank and mud pump as well as additional piping, hosing, or tubing are featured. Electrical and mechanical components required to operate the drilling rig are located on or within the semi-trailer of the present invention.

The functions of the drilling rig are managed by a user operated remote control. In addition to the aforementioned drilling, lifting, and pumping capabilities of the drilling rig, the truck to which the semi-trailer and derrick are attached may be driven and navigated by means of remote control. The truck is fully functional as well with features such as headlights, vehicle horn, and brakes operable via remote control. The object of the present invention is to provide users with a fully functional, scaled model of a mobile drilling rig. The present invention has many applications that range from recreational enjoyment to rig operator basic training and familiarization with the features of full sized conventional drilling rigs. Because the present invention is a fully functional scaled model of a full sized conventional drilling rig, it is noted that various modifications may be required to the design and operation mechanisms of the scaled model. This is primarily due to the impracticality of perfectly replicating various components of full sized drilling rigs. However, any alterations made to the scaled model do not interfere with the ability of the present invention to function in the same manner as its full sized counterpart.

DETAIL DESCRIPTIONS OF THE INVENTION

All illustrations of the drawings are for the purpose of describing selected versions of the present invention and are not intended to limit the scope of the present invention.

The present invention is a remote 8 controlled drilling rig 1 that is fully functional. The remote 8*r* controlled drilling rig 1 comprises a drilling rig 1, an electrical assembly 7, and a remote 8. The drilling rig 1 is a scaled model that is capable of fully performing drilling operations. The electrical assembly 7 is positioned within the drilling rig 1 and allows the drilling rig 1 to receive wireless signals and interpret said signals into commands for controlling the drilling rig 1. The remote 8 is used to send command signals to the electrical assembly 7, and as such, the drilling rig 1 is operatively coupled to the remote 8 through the electrical assembly 7.

Figure 6:
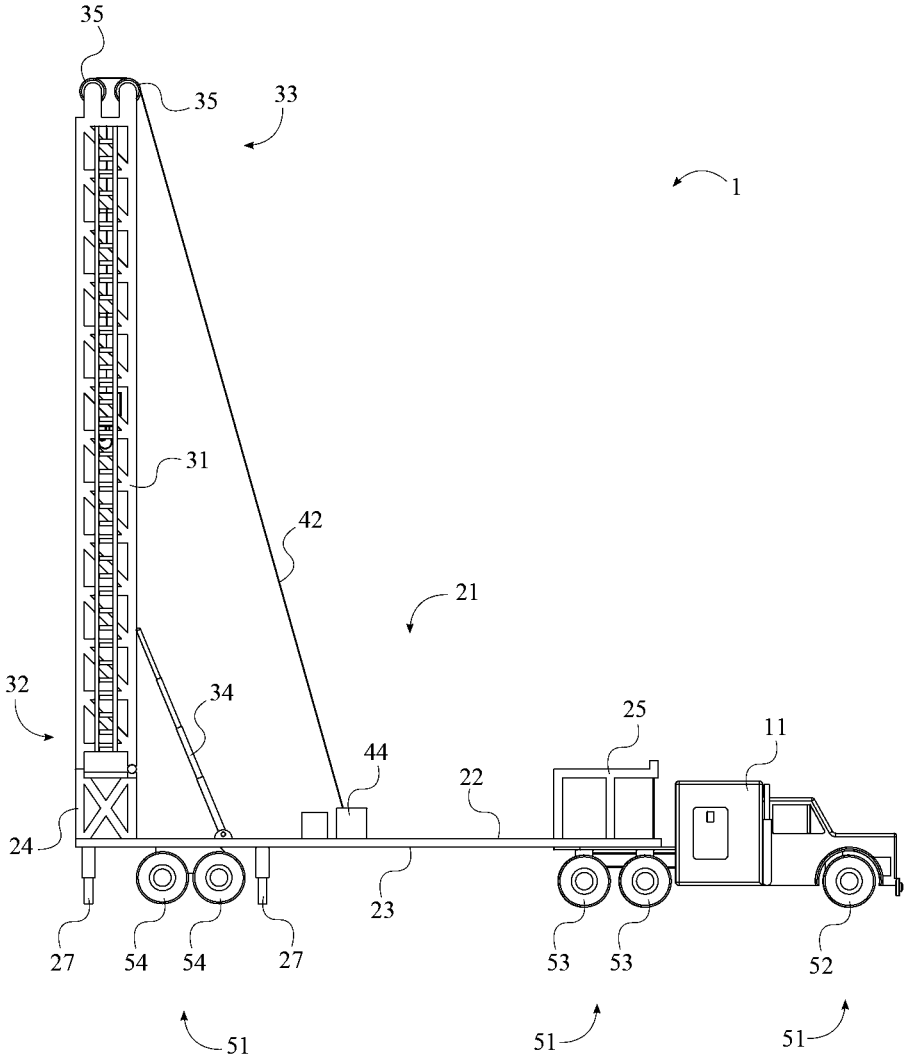
FIG. 6 is a left side elevational view of the drilling rig with the derrick in the vertical position.
Figure 7:
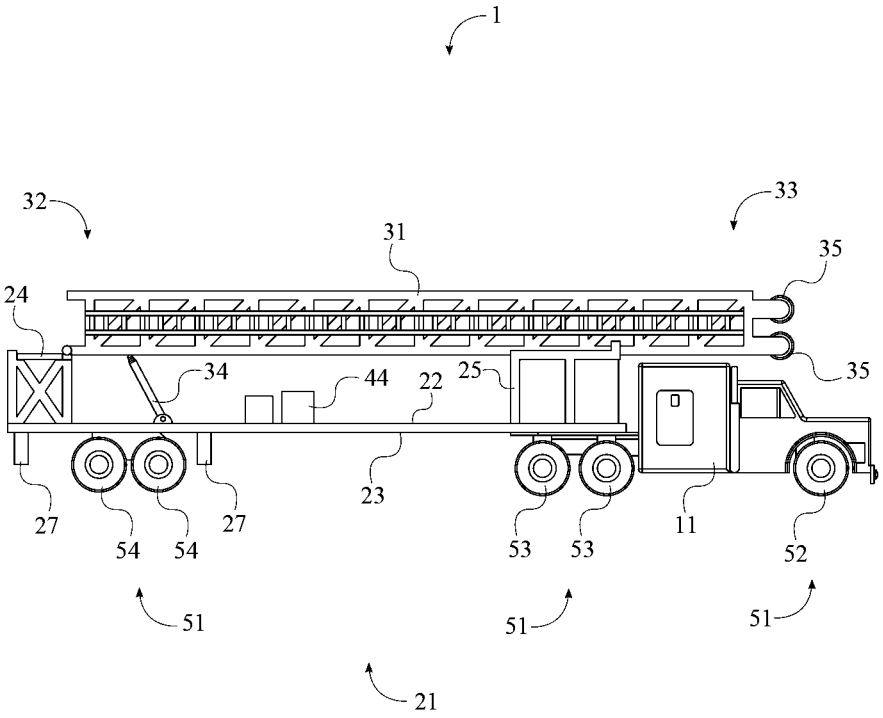
FIG. 7 is a left side elevational view of the drilling rig with the derrick in the horizontal position.

In reference to FIG. 6-7, the drilling rig 1 comprises a truck 11, a semi-trailer 21, a derrick 31, a drilling assembly 41, a plurality of wheels 51, and a drive assembly 61. The semi-trailer 21 is pivotally connected to the truck 11 and supports the derrick 31 and the drilling assembly 41. The plurality of wheels 51 is rotatably mounted to both the truck 11 and the semi-trailer 21, such that the drilling rig 1 may traverse across the desired terrain. The drive assembly 61 is positioned within the truck 11 and is operatively coupled to the plurality of wheels 51 such that the drive assembly 61 dictates the forward, backwards, left, and right movements of the drilling rig 1. The drilling assembly 41 is operatively coupled to the derrick 31 and together the drilling assembly 41 and the derrick 31 are used to perform the desired drilling operations.

Figure 10:
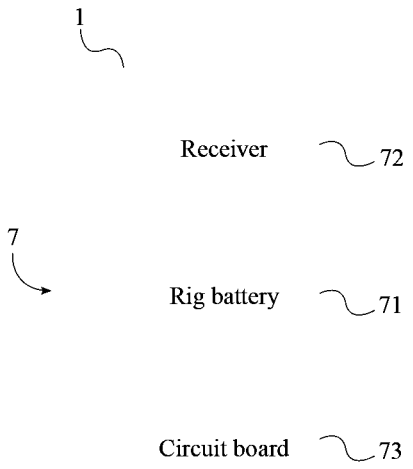
FIG. 10 is a diagram of the electrical assembly positioned within the drilling rig.

In reference to FIG. 10, the electrical assembly 7 is positioned within the drilling rig 1 and comprises a rig battery 71, a receiver 72, and a circuit board 73. The rig battery 71 provides a source of electrical current in order to power various components of the drilling rig 1. As such, the receiver 72 and the circuit board 73 are electrically connected to the rig battery 71. The rig battery 71 can be either replaceable or rechargeable. If the rig battery 71 is replaceable, then an access panel is provided in order to remove the rig battery 71. If the rig battery 71 is rechargeable, then a charging port is provided for attaching a charging cable to the rig battery 71. The receiver 72 is used to retrieve radio waves, or any other type of wireless signal, in regards to command signals sent to control the drilling rig 1. The command signals that are retrieved by the receiver 72 are then sent to the circuit board 73, wherein the circuit board 73 processes the command signals and in turn signals for the control or action of the appropriate components of the drilling rig 1. As such, the receiver 72 is electronically connected to the circuit board 73.

Figure 12:
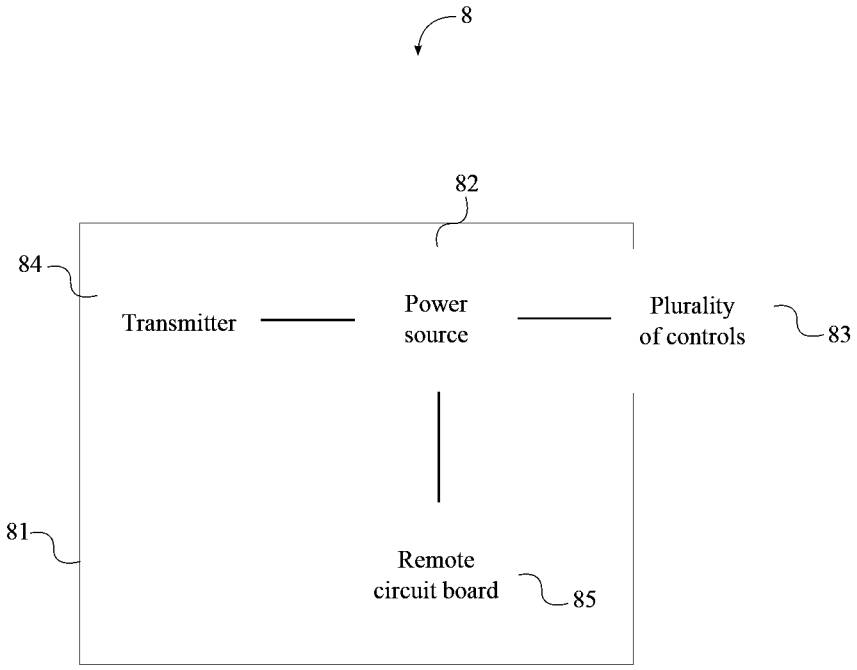
FIG. 12 is a diagram depicting the electrical connections of the remote.
Figure 13:
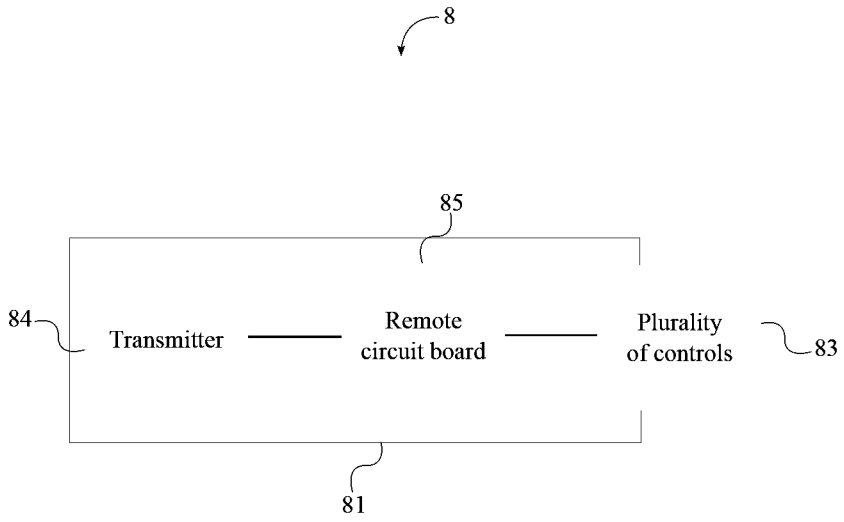
FIG. 13 is a diagram depicting the electronic connections of the remote.

In reference to FIG. 12-13, the remote 8 comprises a casing 81, a transmitter 84, a power source 82, a plurality of controls 83, and a remote circuit board 85. The transmitter 84, the power source 82, and the remote circuit board 85 are positioned within the casing 81, while the plurality of controls 83 are operatively coupled to the casing 81. The power source 82 provides a source of electrical current in order to power the components of the remote 8. As such, the transmitter 84, the plurality of controls 83, and the remote circuit board 85 are electrically connected to the power source 82. The power source 82 can be portable, such as a battery, or fixed, such as a power connection for attaching a power cable from an outlet or other source. If the power source 82 is a battery, then the power source 82 may be replaceable or rechargeable; the remote 8 having an access panel for a replaceable battery and a charging port for a rechargeable battery.

Figure 11:
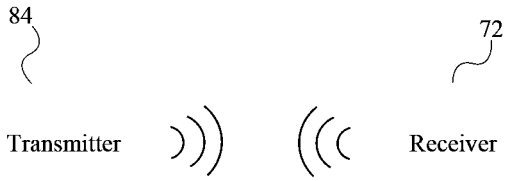
FIG. 11 is a diagram showing the transmitter being communicably coupled to the receiver.

The plurality of controls 83 can include joysticks, push buttons, switches, a touch screen, etc. When operated by a user, the plurality of controls 83 sends an input signal, relating to a desired function of the drilling rig 1, to the remote circuit board 85. In turn the input signal is processed by the circuit board 73 and sent to the transmitter 84. As such, both the plurality of controls 83 and the transmitter 84 are electronically connected to the remote circuit board 85. In reference to FIG. 11, the transmitter 84 is communicably coupled to the receiver 72 of the electrical assembly 7, such that processed input commands are sent to the receiver 72 as command signals through the transmitter 84.

In reference to FIG. 6, the plurality of wheels 51 comprises a pair of front wheels 52, a plurality of drive wheels 53, and a plurality of rear wheels 54. Both the pair of front wheels 52 and the plurality of drive wheels 53 are rotatably mounted to the truck 11; the pair of front wheels 52 and the plurality of drive wheels 53 being positioned opposite each other about the truck 11. A fifth wheel is positioned on the truck 11 adjacent to the plurality of drive wheels 53 and is the point of connection between the truck 11 and the semi-trailer 21. The plurality of rear wheels 54 are positioned opposite the truck 11 along the semi-trailer 21, such that the plurality of drive wheels 53 are positioned in between the pair of front wheels 52 and the plurality of rear wheels 54.

Figure 9:
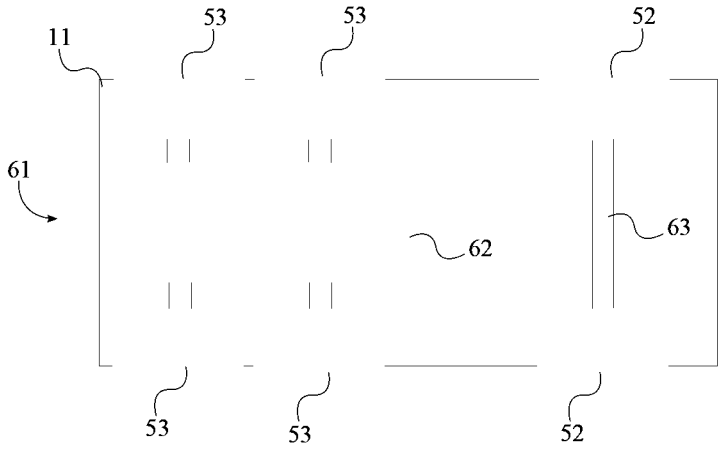
FIG. 9 is a diagram showing the drive assembly positioned within the truck, the powertrain being operatively coupled to the plurality of drive wheels and the steering mechanism being hingedly connected to the pair of front wheels.

In reference to FIG. 9, the drive assembly 61 comprises a powertrain 62 and a steering mechanism 63. The powertrain 62 provides power to the plurality of drive wheels 53 in order to achieve forward and backward motion of the drilling rig 1. As such, the powertrain 62 is operatively coupled to the plurality of drive wheels 53. On the other hand, the steering mechanism 63 provides a means for controlling the left and right movements of the drilling rig 1. The pair of front wheels 52 is hingedly connected to the steering mechanism 63, such that the pair of front wheels 52 may be pivoted left or right in order to induce movement of the drilling rig 1 to the left or right. The powertrain 62 and the steering mechanism 63 are both electrically connected to the rig battery 71 and electronically connected to the circuit board 73. In this way, power is supplied to the powertrain 62 and the steering mechanism 63 as dictated by command signals received from the remote 8.

Figure 2:
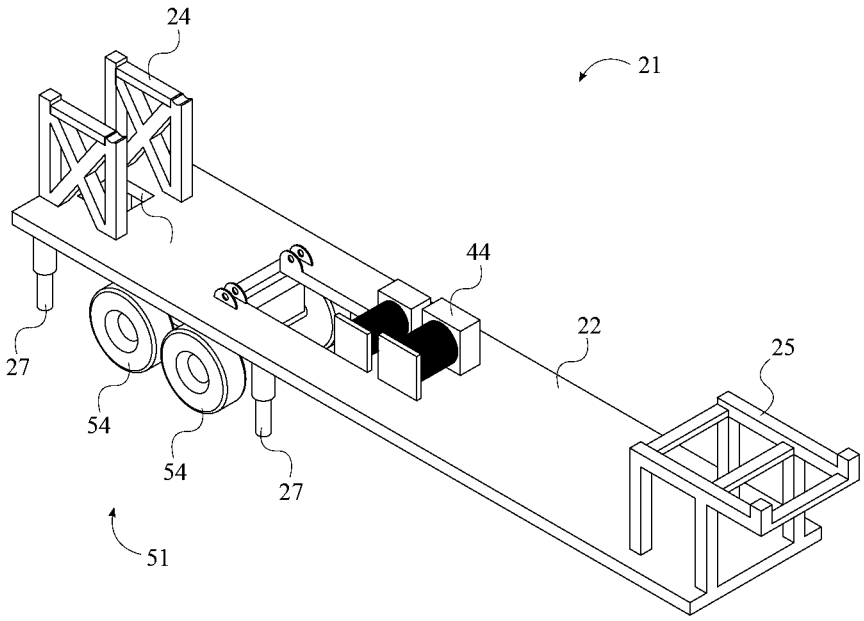
FIG. 2 is a perspective view of the semi-trailer.

In reference to FIG. 2 and FIG. 6-7, the semi-trailer 21 comprises a load bearing surface 22, a supporting surface 23, a support base 24, a support rest 25, a drill opening 26, and a plurality of support beams 27. The load bearing surface 22 and the supporting surface 23 traverse along the semi-trailer 21; the load bearing surface 22 and the supporting surface 23 being positioned opposite each other about the semi-trailer 21. Both the support base 24 and the support rest 25 are connected to the load bearing surface 22; the support base 24 and the support rest 25 being positioned opposite each other along the semi-trailer 21, wherein the truck 11 is positioned adjacent to the support rest 25. The derrick 31 is hingedly connected to the support base 24, wherein the derrick 31 is operable between a horizontal position and a vertical position.

In the preferred embodiment of the present invention, the electrical assembly 7 is positioned within an electrical housing below or adjacent to the support rest 25. The electrical housing may be fully or partially removable as to access the battery for replacement or to perform other maintenance to the electrical assembly 7. It is also possible for the electrical housing to be connected to the supporting surface 23 of the semi-trailer 21. Additionally, the electrical assembly 7 can be alternatively positioned within the truck 11.

Figure 8:
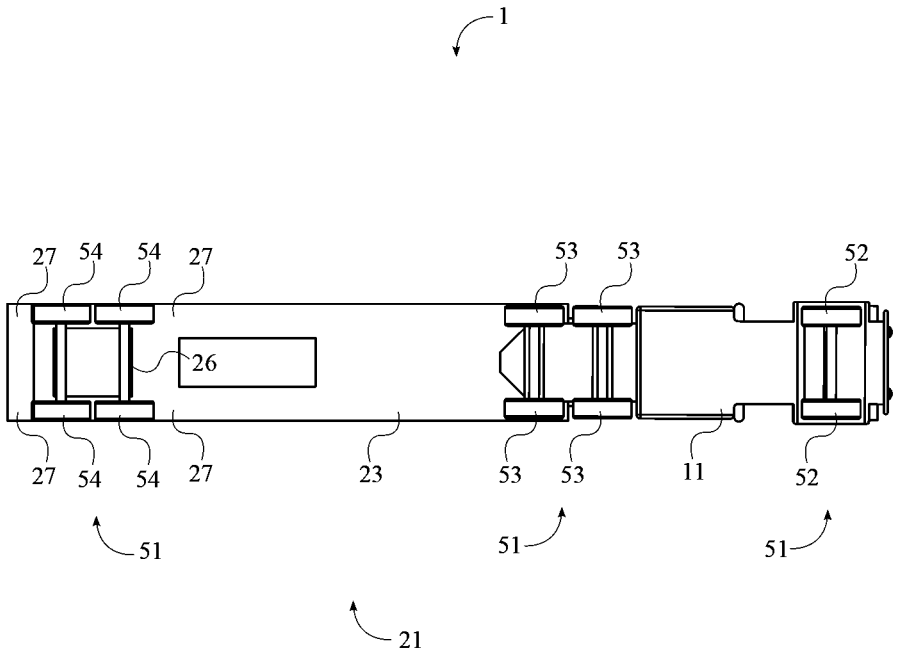
FIG. 8 is bottom plan view of the drilling rig.

In reference to FIG. 8, the drill opening 26 traverses through both the load bearing surface 22 and the supporting surface 23. The drill opening 26 is positioned adjacent to the support base 24, wherein the support base 24 is positioned around the drill opening 26. The drill opening 26 allows components of the drilling assembly 41 that are supported by the derrick 31 to pass through the semi-trailer 21 and into the ground below when the derrick 31 is in the raised, vertical position. The plurality of rear wheels 54 are rotatably mounted to the supporting surface 23, adjacent to the drill opening 26.

Figure 14:
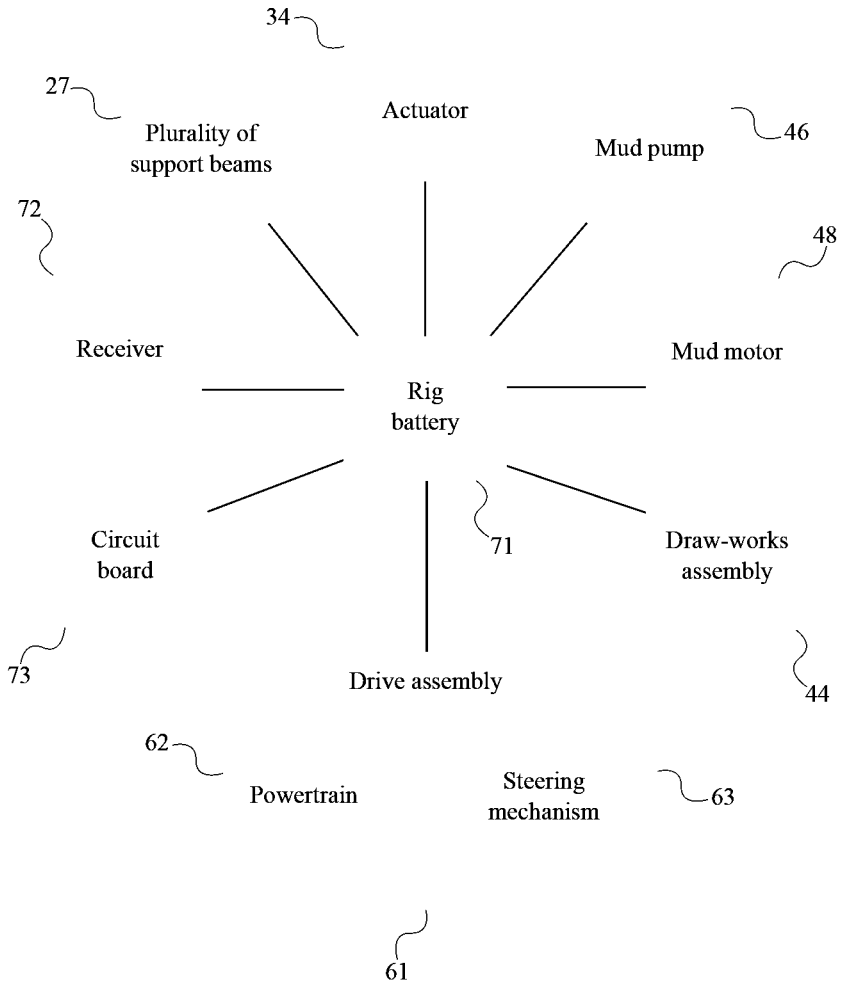
FIG. 14 is a diagram depicting the electrical connections between the drilling rig and the electrical assembly.
Figure 15:
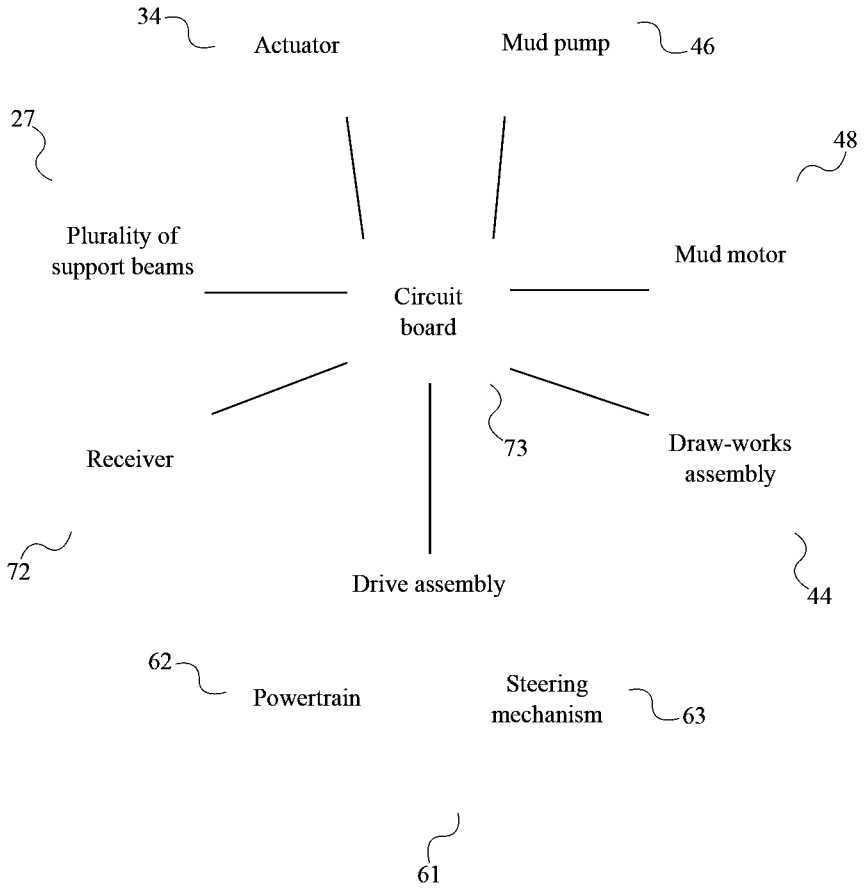
FIG. 15 is a diagram depicting the electrical connections between the drilling rig and the electrical assembly.

In reference to FIG. 6-7, the plurality of support beams 27 are bistably connected to the supporting surface 23 around the plurality of rear wheels 54. The plurality of support beams 27 can be configured between a retracted position and an extended position. When the derrick 31 is raised to the vertical position, the plurality of support beams 27 are first set to the extended position, wherein the plurality of support beams 27 come into contact with the ground and act to support and stabilize the semi-trailer 21. When in the retracted position, the plurality of support beams 27 provide ample clearance with the ground, such that the drilling rig 1 is able to be moved. The plurality of support beams 27 is both electrically connected to the battery and electronically connected to the circuit board 73, as shown in FIG. 14-15 respectively. In this way, power is supplied to the plurality of support beams 27 as dictated by command signals received from the remote 8.

Figure 3:
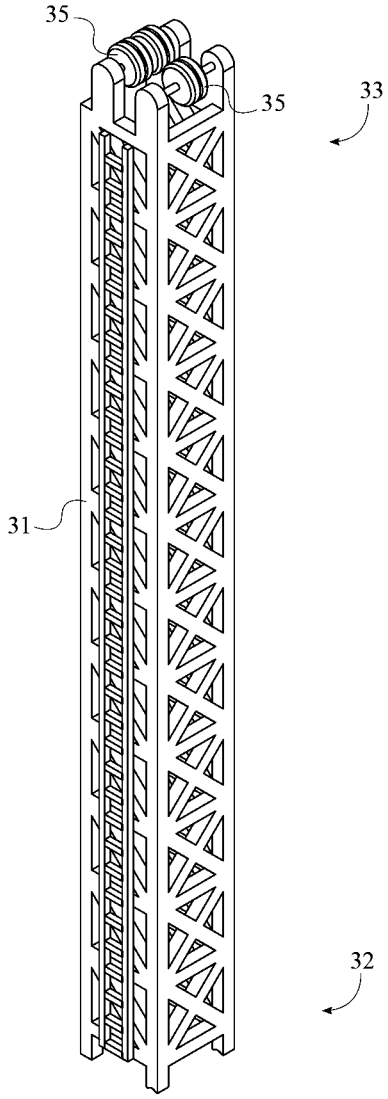
FIG. 3 is a perspective view of the derrick.

In reference to FIG. 3, the derrick 31 comprises a proximal end 32, a distal end 33, an actuator 34, and a plurality of pulleys 35; the proximal end 32 and the distal end 33 being positioned opposite each other along the derrick 31. The plurality of pulleys 35 are rotatably mounted on the distal end 33 and provide a means for engaging the drilling assembly 41 with the derrick 31. The proximal end 32 is hingedly connected to the support base 24 about a common hinge axis, allowing the derrick 31 to transition between the horizontal and vertical position. When in the horizontal position, the derrick 31 is positioned parallel to the semi-trailer 21, wherein the distal end 33 is positioned onto the support rest 25. When in the vertical position, the derrick 31 is positioned perpendicular to the semi-trailer 21, wherein the proximal end 32 is positioned onto the support base 24.

In reference to FIG. 6, a first end of the actuator 34 is positioned adjacent to the proximal end 32 on the derrick 31, while a second end of the actuator 34 is hingedly connected to the load bearing surface 22 adjacent to the support base 24. The actuator 34 provides the driving force required to raise the derrick 31 and maintain the vertical position, as well as safely lower the derrick 31. In the preferred embodiment of the present invention, the actuator 34 is a pair of telescoping rods that can be either hydraulically operated or mechanically operated in order to extend and the retract the pair of telescoping rods. The actuator 34 is both electrically connected to the battery and electronically connected to the circuit board 73, as shown in FIG. 14-15 respectively. In this way, power is supplied to the actuator 34 as dictated by command signals received from the remote 8 in order to activate the hydraulic or mechanical driver and raise or lower the derrick 31.

In the preferred embodiment of the present invention, the derrick 31 is an elongated member having a first side, a second side, and a third side, together forming a U-shaped cross-section. The first side of the derrick 31 lies perpendicular to the second side and third side of the derrick 31 with the second side and third side lying parallel to each other. The first side of the derrick 31 comprises a plurality of truss members that extend along the length of the derrick 31. Similarly, the second side and the third side of the derrick 31 also comprise a plurality of truss members that extend along the length of the derrick 31. A ladder is positioned along the second side that extends from the proximal end 32 of the derrick 31 to the distal end 33 of the derrick 31.

Figure 4:
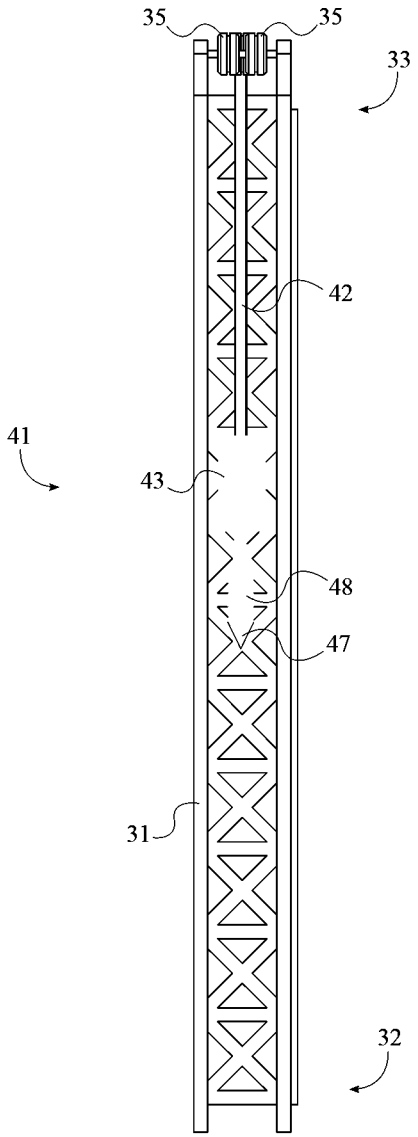
FIG. 4 is a rear elevational view of the derrick showing a drill bit attached to the traveling block.

In reference to FIG. 4 and FIG. 6, the drilling assembly 41 comprises a drilling cable 42, a traveling block 43, and a draw-works assembly 44. The draw-works assembly 44 is connected to the load bearing surface 22 of the semi-trailer 21 and is positioned in between the support base 24 and the support rest 25. The draw-works assembly 44 had a cylindrical drum to which the drilling cable 42 is connected at one end. The drilling cable 42 slidably engages the derrick 31, wherein the drilling cable 42 is coupled to the plurality of pulleys 35. The traveling block 43 is connected to the drilling cable 42 opposite the draw-works assembly 44. The traveling block 43 is freely positioned within the derrick 31 such that the traveling block 43 may be raised or lowered when the derrick 31 is in the vertical position. The draw-works assembly 44 is both electrically connected to the battery and electronically connected to the circuit board 73, as shown in FIG. 14-15 respectively. In this way, power is supplied to the draw-works assembly 44 as dictated by command signals received from the remote 8 in order to wind or unwind the drilling cable 42 and in turn raise or lower the traveling block 43 within the derrick 31.

In reference to FIG. 4, the drilling assembly 41 may further comprise a mud motor 48 and a drill bit 47. The mud motor 48 is attached to the traveling block 43 opposite the drilling cable 42. The drill bit 47 is rotatably connected to the mud motor 48 opposite the traveling block 43, such that when the traveling block 43 is lowered the drill bit 47 may penetrate the ground as it is spun by the mud motor 48. The mud motor 48 is both electrically connected to the battery and electronically connected to the circuit board 73, as shown in FIG. 14-15 respectively. In this way, power is supplied to the mud motor 48 as dictated by command signals received from the remote 8 in order to activate spinning, deactivate spinning, or reverse the spinning direction of the drill bit 47.

Figure 5:
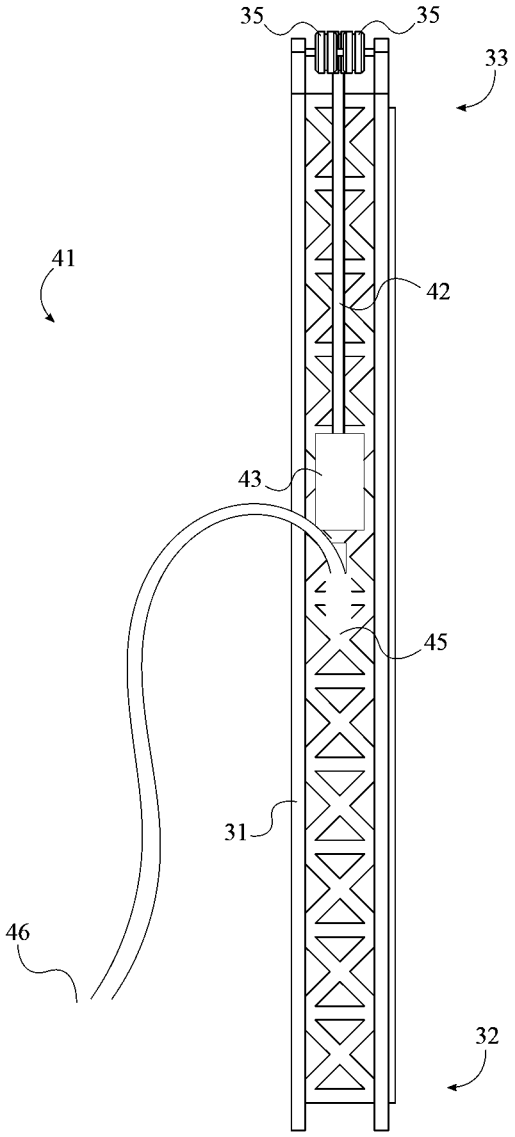
FIG. 5 is a rear elevational view of the derrick showing a fluid conduit attached to the traveling block.

In reference to FIG. 5, the drilling assembly 41 may also further comprise a fluid conduit 45 and a mud pump 46. The fluid conduit 45 can be any hollow tubing, piping, etc. and is attached to the traveling block 43 opposite the drilling cable 42. The fluid conduit 45 is adjacently connected to the mud pump 46, wherein the fluid conduit 45 and the mud pump 46 are is fluid communication with one another. Once the fluid conduit 45 is inserted into a drilled hole, the mud pump 46 is activated in order to pull fluids up through the fluid conduit 45. The mud pump 46 may be connected to the load bearing surface 22 of the semi-trailer 21 or positioned off of the trailer adjacent to the drilling rig 1. Fluid removed from the hole is deposited into a storage receptacle that can either be dug into the ground or otherwise positioned adjacent to the drilling rig 1. The mud pump 46 is both electrically connected to the battery and electronically connected to the circuit board 73, as shown in FIG. 14-15 respectively. In this way, power is supplied to the mud pump 46 as dictated by command signals received from the remote 8 in order to pull fluids up through the fluid conduit 45.

Figure 1:
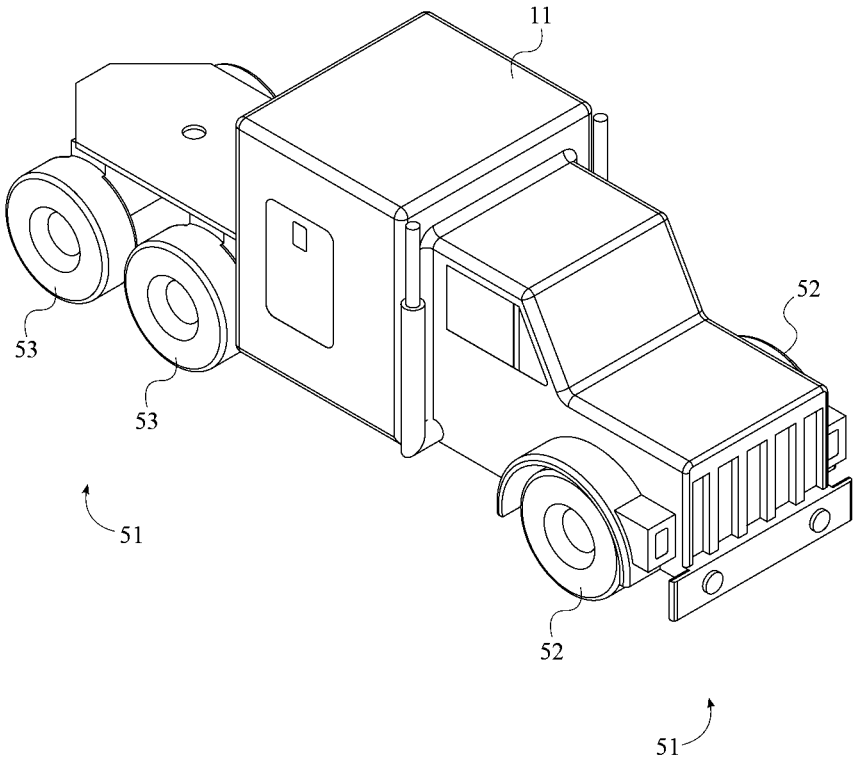
FIG. 1 is a perspective view of the truck.

In reference to FIG. 1, in addition to the functioning components described above, the truck 11 may further comprise scaled down embodiments of conventional truck 11 features such as headlights, windows, a horn, brakes, and a front bumper, amongst others. Operable components such as headlights, windows, and a horn are electrically connected to the battery and electronically connected to the circuit board 73 similar to the other remote 8ly controlled components of the present invention.

Alternative embodiments of the present invention may feature various modifications to the aesthetic design of the truck 11, semi-trailer 21, and derrick 31. Additionally, the present invention may be altered to accommodate for various drilling types and mechanisms. Example drill types include, but are not limited to, reverse circulation drilling and mud rotary drilling.

Although the invention has been explained in relation to its preferred embodiment, it is to be understood that many other possible modifications and variations can be made without departing from the spirit and scope of the invention as hereinafter claimed.

What is claimed is:

1. A remote controlled drilling rig comprises:
a drilling rig;
an electrical assembly;
a remote;
the drilling rig comprises a truck, a semi-trailer, a derrick, a drilling assembly, a plurality of wheels, and a drive assembly;
the electrical assembly comprises a rig battery, a receiver, and a circuit board;
the remote comprises a transmitter;
the semi-trailer comprises a load bearing surface, a supporting surface, a support base, and a support rest;
the load bearing surface and the supporting surface traversing along the semi-trailer;
the load bearing surface and the supporting surface being positioned opposite each other about the semi-trailer;
the support base and the support rest being connected to the load bearing surface;
the support base and the support rest being positioned opposite each other along the semi-trailer;
the semi-trailer being pivotally connected to the truck;
the truck being positioned adjacent to the support rest;
the drive assembly being positioned within the truck;
the derrick being hingedly connected to the support base;
the drilling assembly being operatively coupled to the derrick;
the plurality of wheels being rotatably mounted to both the truck and the semi-trailer;
the plurality of wheels being operatively coupled to the drive assembly;
the electrical assembly being positioned within the drilling rig;
the drilling rig being operatively coupled to the remote through the electrical assembly;
the transmitter being communicably coupled to the receiver;
the derrick, the drilling assembly, the drive assembly, the circuit board, and the receiver being electrically connected to the rig battery;
the derrick, the drilling assembly, the drive assembly, and the receiver being electronically connected to the circuit board;
the semi-trailer further comprises a drill opening;
the drill opening traversing through both the load bearing surface and the supporting surface;
the drill opening being positioned adjacent to the support base;
the support base being positioned around the drill opening.

2. The remote controlled drilling rig as claimed in claim 1 comprises:
the plurality of wheels comprises a pair of front wheels, a plurality of drive wheels, and a plurality of rear wheels;
the pair of front wheels and the plurality of drive wheels being rotatably mounted to the truck;
the pair of front wheels and the plurality of drive wheels being positioned opposite each other about the truck;
the plurality of rear wheels being positioned opposite the truck along the semi-trailer;
the plurality of rear wheels being rotatably mounted on the supporting surface; and
the plurality of drive wheels being positioned in between the pair of front wheels and the plurality of rear wheels.

3. The remote controlled drilling rig as claimed in claim 1 comprises:
the drive assembly comprises a powertrain and a steering mechanism;
the plurality of wheels comprises a pair of front wheels and a plurality of drive wheels;
the pair of front wheels being hingedly connected to the steering mechanism; and
the plurality of drive wheels being operatively coupled to the powertrain.

4. The remote controlled drilling rig as claimed in claim 1 comprises:
the drive assembly further comprises a powertrain and a steering mechanism;
the powertrain and the steering mechanism being electrically connected to the rig battery; and
the drive train and the steering mechanism being electronically connected to the circuit board.

5. The remote controlled drilling rig as claimed in claim 1 comprises:
the semi-trailer further comprises a plurality of support beams; and
the plurality of support beams being bistably connected to the supporting surface.

6. The remote controlled drilling rig as claimed in claim 1 comprises:
the semi-trailer further comprises a plurality of support beams;
the plurality of support beams being electrically connected to the rig battery; and
the plurality of support beams being electronically connected to the circuit board.

7. The remote controlled drilling rig as claimed in claim 1 comprises:
the derrick comprises a proximal end, a distal end, an actuator, and a plurality of pulleys;
the proximal end and the distal end being positioned opposite each other along the derrick;
the proximal end being hingedly connected to the support base;
the plurality of pulleys being rotatably mounted on the distal end;
the actuator being positioned adjacent to the proximal end; and
the actuator being hingedly connected to the load bearing surface adjacent to the support base.

8. The remote controlled drilling rig as claimed in claim 1 comprises:
the derrick further comprises an actuator;
the actuator being electrically connected to the rig battery; and
the actuator being electronically connected to the circuit board.

9. The remote controlled drilling rig as claimed in claim 1 comprises:
the drilling assembly comprises a drilling cable, a traveling block, and a draw-works assembly;
the draw-works assembly connected to the load bearing surface;
the draw-works assembly being positioned in between the support base and the support rest;
the drilling cable being connected to the draw-works assembly;

the drilling cable slidably engaging the derrick; and the traveling block being connected to the drilling cable opposite the draw-works assembly.

10. The remote controlled drilling rig as claimed in claim 9 comprises:

the drilling assembly further comprises a fluid conduit and a mud pump;

the fluid conduit being attached to the traveling block opposite the drilling cable;

the fluid conduit being adjacently connected to the mud pump; and the fluid conduit and the mud pump being in fluid communication with each other.

11. The remote controlled drilling rig as claimed in claim 9 comprises:

the drilling assembly further comprises a mud motor and a drill bit;

the mud motor being attached to the traveling block opposite the drilling cable; and the drill bit being rotatably connected to the mud motor opposite the traveling block.

12. The remote controlled drilling rig as claimed in claim 1 comprises:

the drilling assembly further comprises a draw-works assembly;

the draw-works assembly being electrically connected to the rig battery; and the draw-works assembly being electronically connected to the circuit board.

13. The remote controlled drilling rig as claimed in claim 1 comprises:

the drilling assembly further comprises a mud pump;

the mud pump being electrically connected to the rig battery; and the mud pump being electronically connected to the circuit board.

14. The remote controlled drilling rig as claimed in claim 1 comprises:

the drilling assembly further comprises a mud motor;

the mud motor being electrically connected to the rig battery; and the mud motor being electronically connected to the circuit board.

15. The remote controlled drilling rig as claimed in claim 1 comprises:

the derrick comprises a plurality of pulleys;

the drilling assembly comprises a drilling cable and a traveling block;

the traveling block being connected to the drilling cable;

the traveling block being positioned within the derrick; and the drilling cable being coupled to the plurality of pulleys, wherein the traveling block is able to traverse up and down the derrick.

16. The remote controlled drilling rig as claimed in claim 1 comprises:

the remote further comprises a casing, a power source, a plurality of controls, and a remote circuit board;

the power source, the transmitter, and the remote circuit board being positioned within the casing;

the plurality of controls being operatively coupled to the casing;

the transmitter, the plurality of controls, and the remote circuit board being electrically connected to the power source; and the plurality of controls and the transmitter being electronically connected to the remote circuit board.

17. The remote controlled drilling rig as claimed in claim 1 comprises:

the derrick being positioned parallel to the semi-trailer; and the distal end being positioned onto the support rest.

18. The remote controlled drilling rig as claimed in claim 1 comprises:

the derrick being positioned perpendicular to the semi-trailer; and a proximal end of the derrick being positioned onto the support base.

* * * * *